US009033199B2

(12) United States Patent
Weber

(10) Patent No.: US 9,033,199 B2
(45) **Date of Patent: *May 19, 2015**

(54) LANYARD WITH TOOL COUPLED THERETO AND RELATED SYSTEM AND METHOD

(71) Applicant: Trent Weber, San Francisco, CA (US)

(72) Inventor: Trent Weber, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 221 days.

This patent is subject to a terminal disclaimer.

(21) Appl. No.: 13/621,821

(22) Filed: Sep. 17, 2012

(65) Prior Publication Data

US 2014/0076945 A1 Mar. 20, 2014

(51) Int. Cl.
*A45F 5/00* (2006.01)
*A45F 3/14* (2006.01)

(52) U.S. Cl.
CPC ..... *A45F 5/00* (2013.01); *Y10T 29/49826* (2015.01); *A45F 3/14* (2013.01); *A45F 2005/006* (2013.01)

(58) Field of Classification Search
CPC ..... A45F 5/00; A45F 3/14; A45F 2003/14; A45F 2003/142
USPC ..... 224/255, 257
See application file for complete search history.

(56) References Cited

U.S. PATENT DOCUMENTS 4,152,564 A * 5/1979 Wirz ..... 200/530
4,417,113 A * 11/1983 Saito et al. ..... 200/302.2
4,502,181 A * 3/1985 Gonas ..... 16/445
4,616,868 A * 10/1986 Okuda ..... 294/137
4,702,447 A * 10/1987 Westwood, III ..... 248/231.51
5,379,928 A * 1/1995 Mikkelsen ..... 224/257
5,938,532 A * 8/1999 Wall ..... 463/47.2
6,182,169 B1 * 1/2001 Force et al. ..... 710/62
6,216,319 B1 * 4/2001 Elkins ..... 24/3.2
7,124,470 B2 10/2006 Alanis
7,387,434 B2 * 6/2008 Hiranuma et al. ..... 368/319
7,458,489 B1 * 12/2008 Mudd et al. ..... 224/197
7,650,007 B2 1/2010 Iuliis et al.
7,774,969 B1 * 8/2010 Silverman ..... 40/661
7,810,683 B2 * 10/2010 Chan ..... 224/222
7,871,720 B2 * 1/2011 Myers et al. ..... 429/123
7,904,128 B2 3/2011 Harmon et al.
8,055,005 B2 * 11/2011 Liu et al. ..... 381/374
8,208,978 B2 6/2012 Stiehl et al.
8,295,533 B1 * 10/2012 Schachtman ..... 381/385
2005/0115999 A1 * 6/2005 Johnson ..... 224/269
2008/0145142 A1 * 6/2008 Winslow ..... 403/322.1
2009/0120980 A1 * 5/2009 Calayo ..... 224/257
2009/0290296 A1 * 11/2009 Stiehl et al. ..... 361/679.01
2010/0171021 A1 * 7/2010 Smith ..... 248/558
2010/0206976 A1 * 8/2010 Salentine et al. ..... 242/379.2
2010/0216526 A1 * 8/2010 Chen et al. ..... 455/575.1

(Continued)

*Primary Examiner* — Brian D Nash
(74) *Attorney, Agent, or Firm* — Downey Brand LLP

(57) ABSTRACT

Attachment mechanisms may be employed to attach accessory devices to electronic devices. The attachment mechanisms may each include a displaceable post that is moveable between recessed and extended configurations. In the extended configuration an accessory may be attached to the displaceable post, whereas in the recessed configuration the displaceable post may be at least partially inaccessible. The accessory device may be a lanyard with a tool coupled thereto. The tool may be configured to engage a head of the accessory device to rotate the displaceable post and move the accessory device between the recessed configuration and the extended configuration. The tool may be embedded in the lanyard.

19 Claims, 15 Drawing Sheets

(56) References Cited

U.S. PATENT DOCUMENTS

| | | | | |
|---|---|---|---|---|
| 2011/0072639 | A1* | 3/2011 | Myers et al. | 29/592.1 |
| 2011/0188178 | A1* | 8/2011 | Myers et al. | 361/679.01 |
| 2011/0226823 | A1 | 9/2011 | Jasa | |
| 2012/0176760 | A1* | 7/2012 | Cohen et al. | 361/807 |
| 2013/0122293 | A1* | 5/2013 | Weber et al. | 428/365 |
| 2013/0149584 | A1* | 6/2013 | Myers et al. | 429/123 |
| 2013/0294020 | A1* | 11/2013 | Rayner et al. | 361/679.01 |
| 2014/0001216 | A1* | 1/2014 | Whitley et al. | 224/258 |
| 2014/0004763 | A1* | 1/2014 | Whitley et al. | 442/1 |
| 2014/0068919 | A1* | 3/2014 | Weber et al. | 29/525.01 |

* cited by examiner

LANYARD WITH TOOL COUPLED THERETO AND RELATED SYSTEM AND METHOD

TECHNICAL FIELD

The present disclosure relates generally to accessory devices configured to engage attachment mechanisms, and more particularly to lanyards configured to engage attachment mechanisms coupled to an electronic device and associated tools.

BACKGROUND

Various methods and apparatuses have been developed for coupling accessory devices to other items. For example, eyelets, hook and loop fasteners, threaded fasteners, and other mechanisms have been developed for this purpose. Such mechanisms are employed in a wide variety of applications.

By way of example, in the field of electronic devices, lanyards may be coupled thereto by looping the lanyard through an eyelet coupled to the electronic device to provide a user with a way to secure the device to his or her hand. Further, electronic devices such as cameras may include a female threaded boss configured to receive a male threaded member of a tripod. However, existing embodiments of mechanisms configured to couple accessory devices to devices such as electronic devices may prove unsatisfactory to a user. In this regard, existing embodiments of such mechanisms may detract from the aesthetic appeal of the device or alter the form factor of the device to a less desirable configuration. Further, tools may be required to attach the accessory devices to the attachment mechanisms.

Accordingly, improved apparatuses, systems, and methods for attaching accessory devices may be desirable.

SUMMARY

Attachment mechanisms may be configured to couple accessory devices such as lanyards to electronic devices. In one example embodiment, an attachment mechanism includes a displaceable post that is moveable between extended (deployed) and recessed (stored) configurations. The displaceable post may include an enlarged head to which an accessory device may be mounted. In the recessed configuration, the displaceable post is retracted such that the enlarged head is at least partially inaccessible. For example, the enlarged head may define a smooth surface with the surrounding housing of the electronic device such that the attachment mechanism does not adversely affect the cosmetic appearance of the electronic device. However, when the displaceable post is moved outwardly to the extended configuration, the enlarged head is exposed and accessible, such that an accessory device may be coupled thereto.

The accessory device may comprise a lanyard with an opening configured to engage the attachment mechanism. The accessory device may also include a tool. The tool may be configured to engage the attachment mechanism to move the attachment mechanism between the recessed and extended configurations. For example, the tool may define two or more prongs configured to engage a similar number of recesses in the head of the attachment mechanism. Alternatively, the engagement mechanism may define a flat head screwdriver configured to engage a slot in the head of the attachment mechanism. Various other shapes and types of engagement mechanisms are also provided.

The tool may be coupled to the lanyard. For example, the tool may be embedded between layers of material defining the lanyard. The engagement mechanism may extend through at least one of the layers of material defining the lanyard such that the engagement mechanism may engage an attachment mechanism, as described above. Accordingly, the tool usable to move the attachment mechanism between the recessed and extended positions may always be conveniently available when use of the accessory device is desired.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed assemblies, methods, and systems. These drawings in no way limit any changes in form and detail that may be made to the disclosure by one skilled in the art without departing from the spirit and scope of the disclosure.

DETAILED DESCRIPTION

Example applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

Figure 1:
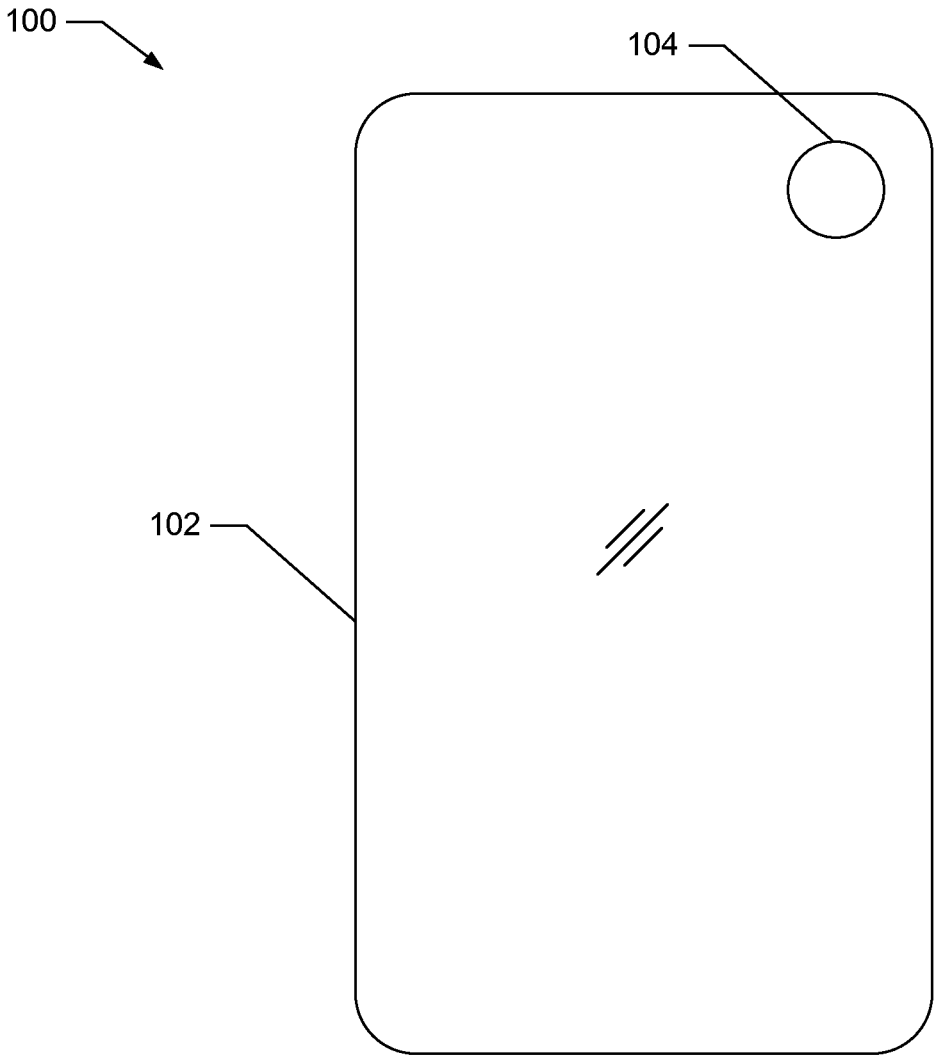
FIG. 1 illustrates a rear view of an electronic device including an attachment mechanism according to an example embodiment of the present disclosure.

Attachment mechanisms may be employed for a variety of purposes. In this regard, FIG. 1 illustrates an embodiment of an electronic device 100. The electronic device 100 may comprise a housing 102 and an attachment mechanism 104. The attachment mechanism 104 may be configured to engage an accessory device, such as an embodiment of the lanyards disclosed below, to form a system.

Various embodiments of attachment mechanisms may be employed to couple an accessory device to the electronic device 100. For example, a stationary attachment mechanism may extend from the housing 102 of the electronic device 100. However, a stationary attachment mechanism may be undesirable for cosmetic reasons. Additionally, a stationary attachment mechanism may affect the ability of the electronic device to lie flat on a surface such as a table, even when the attachment mechanism is not in use.

Figure 2:
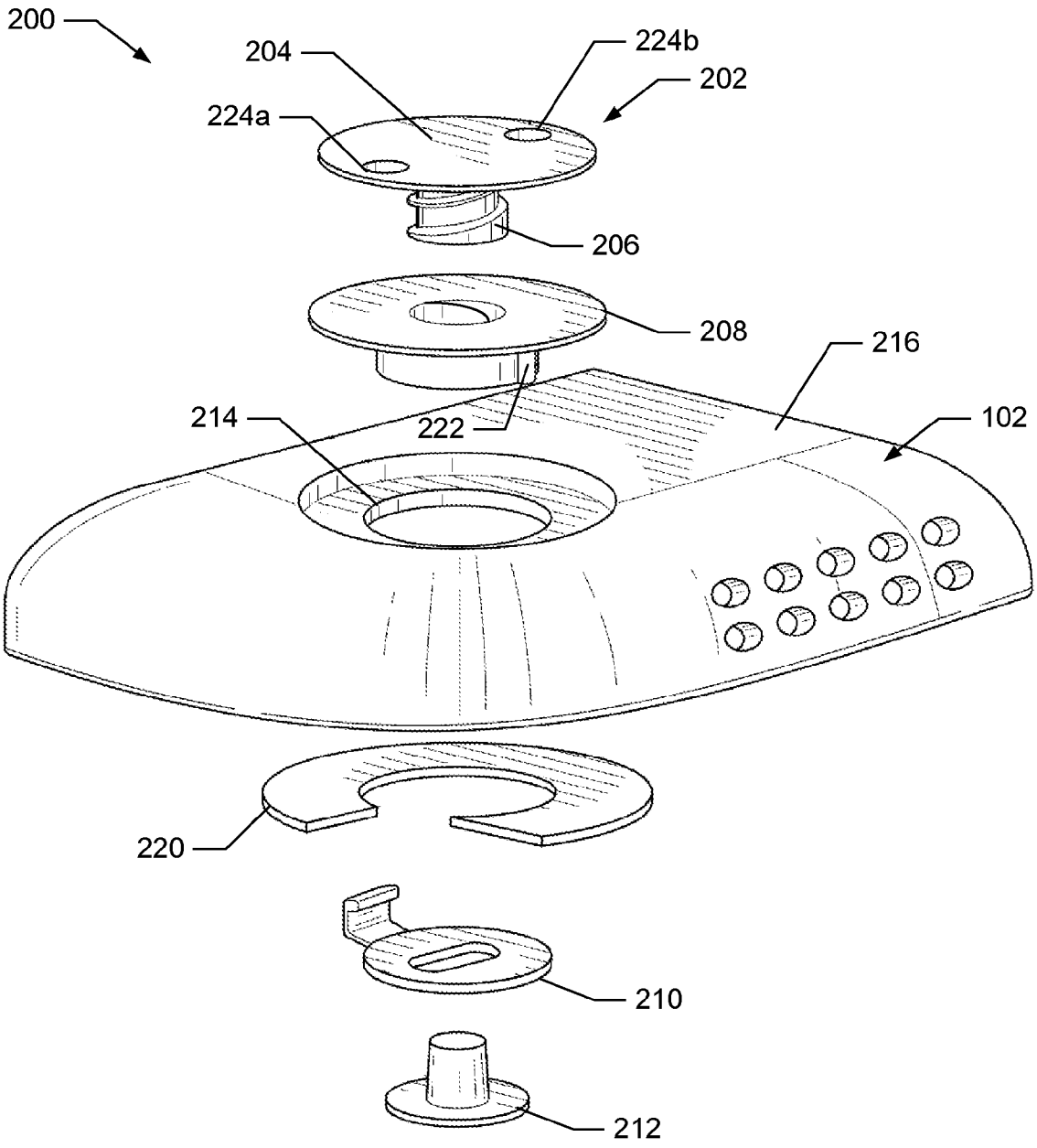
FIG. 2 illustrates an exploded view of an attachment mechanism comprising a post that is rotatable between recessed and extended configurations according to an example embodiment of the present disclosure.

Accordingly, attachment mechanisms that are moveable between retracted and extended configurations may be desirable. For example, FIG. 2 illustrates an embodiment of an attachment mechanism 200, which may be employed to couple an accessory device such as a lanyard thereto. As illustrated, the attachment mechanism 200 includes a displaceable post 202 comprising a head 204 and a shaft 206, wherein the head is enlarged relative to the shaft. The attachment mechanism 200 further comprises a displacement mechanism comprising a receptacle 208, a follower 210, and a fastener 212.

The displaceable post 202 and the receptacle 208 are inserted through an aperture 214 in an outer surface 216 of the housing 102, and the follower 210, and the fastener 212 are connected thereto proximate an inner surface of the housing. More particularly, the displaceable post 202 and the receptacle 208 including matching threads and recesses that allow that displaceable post to screw into and out of the receptacle. A clip 220 engages the housing 102 and the receptacle 208 and the fastener 212 holds the follower 210 to the displaceable post.

Due to the threaded engagement between the displaceable post 202 and the receptacle 208, the displaceable post may be moved between recessed and extended configurations by rotating the displaceable post. As the displaceable post 202 rotates, the follower 210, which may be fixed thereto via the fastener 212, may also rotate and contact a protrusion 222 on an outer surface of the receptacle 208. This contact may provide the user with a satisfying click and/or increase in force indicative of the displaceable post 202 reaching the fully extended configuration. In the extended configuration, a lanyard or other accessory device may be coupled to the displaceable post 202, whereas in the recessed configuration the displaceable post may be at least partially recessed in the displacement mechanism and the head 204 may be at least partially inaccessible.

In order to allow for rotation of the displaceable post 202, while maintaining a relatively smooth exterior surface, the displaceable post may include one or more recesses in the head 204 configured to receive a tool to allow for rotation thereof. In the illustrated embodiment two round recesses 224*a,b* are provided in the head 204. However, it should be understood that various other shapes, sizes, and numbers of recesses may be provided in the head of the attachment mechanism. Further, it should be understood that the attachment mechanism 200 described above is merely one of many embodiments of attachment mechanisms that are configured for engagement with a tool and movement between recessed and extended configurations. In this regard, in another embodiment the head may define one or more protrusions extending therefrom that are configured to engage recesses in a tool. Various other example embodiments of attachment mechanisms that may be employed in accordance with the present disclosure are provided in U.S. patent application Ser. No. 13/607,635, filed Sep. 7, 2012, which is incorporated herein by reference.

However, one issue with embodiments of attachment mechanisms that employ tools to move the attachment mechanisms between recessed and extended configurations is that a user must somehow retain possession of the tool so that it is conveniently available for use. In this regard, if the tool is, for example, retained on a keychain, the user may not always have the keychain with him or her at the time the user needs the tool. Accordingly, Applicants have determined that it may be desirable to retain the tool configured to engage the attachment mechanism in a convenient location for use in moving the attachment mechanism between the recessed and extended positions. More particularly, Applicants have determined that it may be desirable to couple the tool to an accessory device configured to engage the attachment mechanism.

Figure 3:
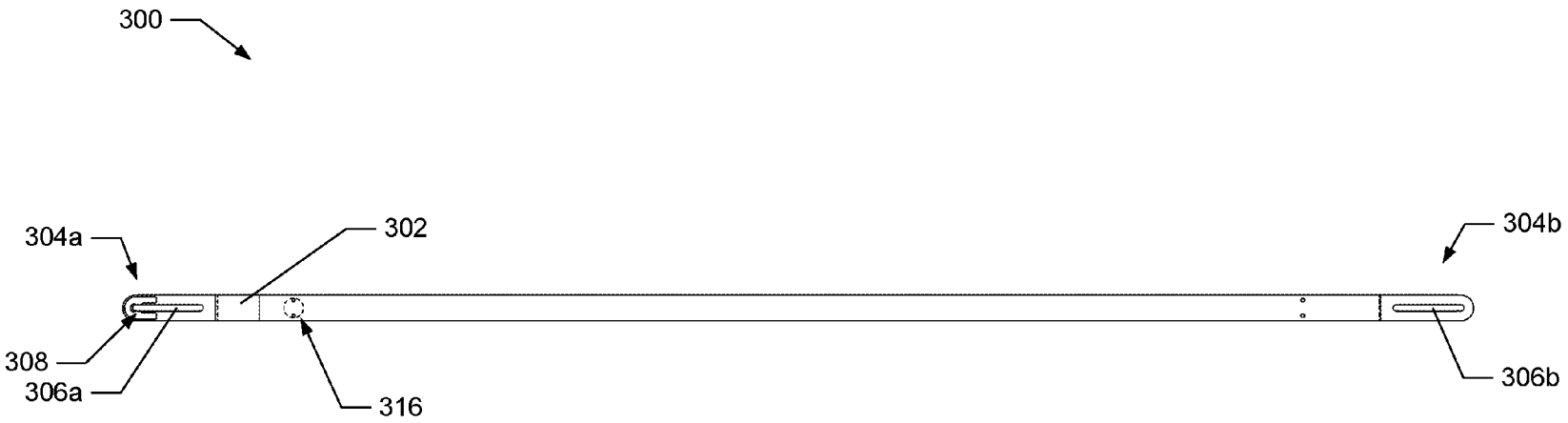
FIG. 3 illustrates an overhead view of an embodiment of an accessory device comprising a lanyard and a tool embedded therein according to an example embodiment of the present disclosure.
Figure 4:
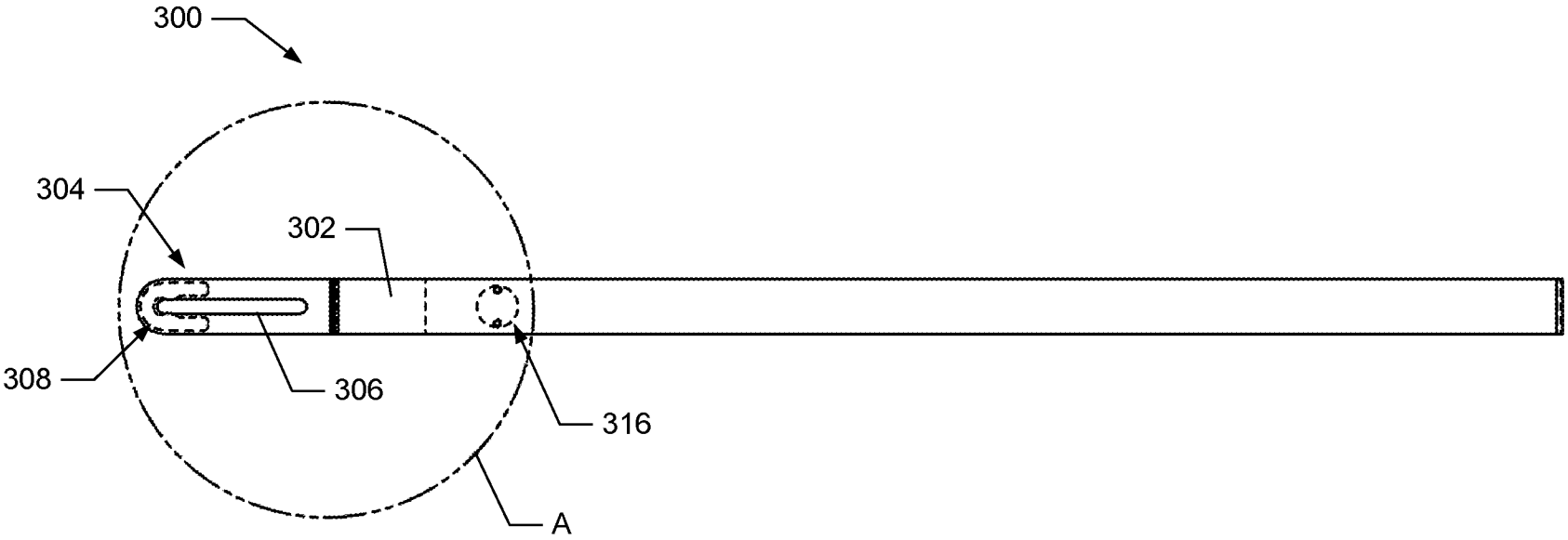
FIG. 4 illustrates an overhead view of the accessory device of FIG. 3 when the lanyard is configured into a loop configuration.

By way of example, FIG. 3 illustrates an overhead view of a lanyard 300 configured to engage an attachment mechanism, such as the above-described attachment mechanism 200 and various other embodiments of attachment mechanisms. The lanyard 300 is illustrated in an unfolded configuration in FIG. 3. However, when fully assembled, the lanyard 300 may define a loop, as illustrated in FIG. 4. In this regard, the lanyard 300 may comprise an adhesive member 302, or other mechanism configured to join first and second portions of the lanyard together to form a loop. For example, in the illustrated embodiment the adhesive member 302 is configured to join first and second ends 304*a,b* of the lanyard together to form the loop.

As further illustrated in FIG. 3, the lanyard 300 may define one or more openings 306*a,b*. The openings 306*a,b* may be configured to overlap one-another to define a single opening 306 when the ends 304*a,b* of the lanyard 300 are joined together to define a loop with a single end 304, as illustrated in FIG. 4. The opening 306 may be configured to engage a head of an attachment mechanism, as described above, such that the lanyard 300 may couple to an electronic device, or other device.

Figure 5:
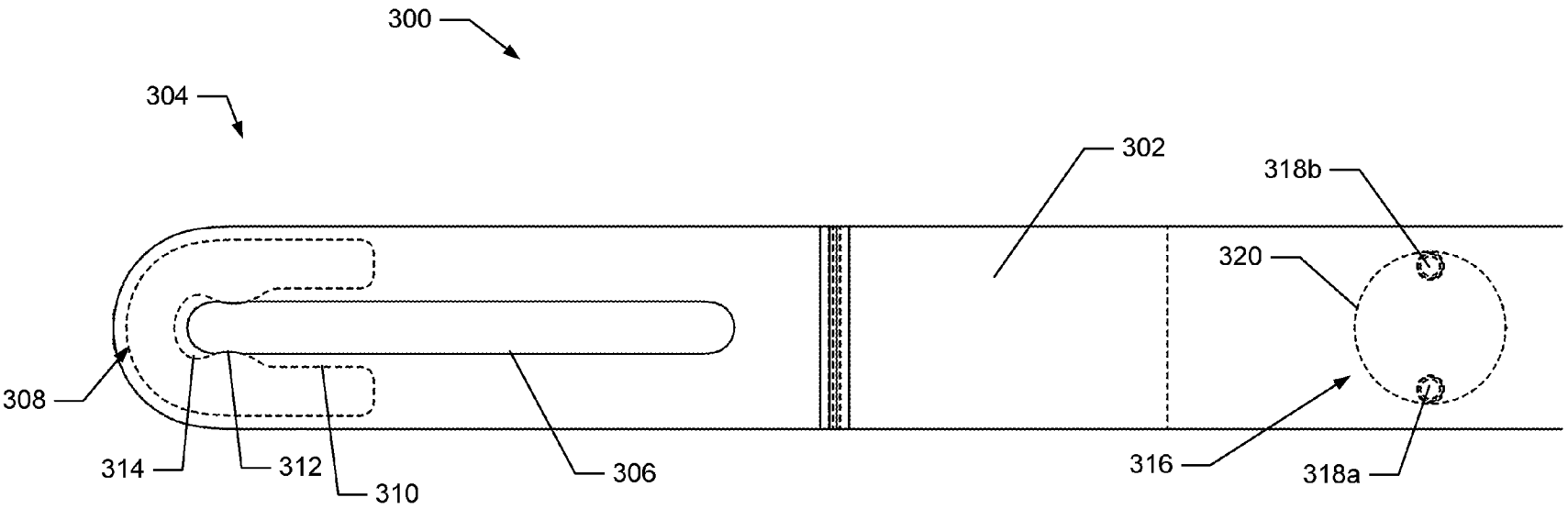
FIG. 5 illustrates an enlarged view of inset A of the accessory device from FIG. 4.

FIG. 5 illustrates an enlarged view of inset A of FIG. 4. As illustrated, the lanyard 300 may further comprise support member 308. The support member 308 may be configured to provide support to the opening 306 and provide secure engagement with the shaft of an attachment mechanism. In this regard, the support member 308 may define a major opening 310, a constriction 312, and a minor opening 314. After the head of the attachment mechanism is received through the opening 306 in the lanyard 300, a shaft of the attachment mechanism may directed through the major opening 310 and the constriction 312, and into the minor opening 314 of the support member 308. The minor opening 314 may define dimensions configured to engage the shaft of the attachment mechanism to thereby provide a secure connection between the lanyard 300 and the attachment mechanism. The support member 308 may be formed from a relatively rigid material such as metal or plastic that allows for a secure engagement with the attachment mechanism.

As further illustrated in FIG. 5, a tool 316 may be coupled to the lanyard 300. The tool 316 may comprise an engagement mechanism configured to engage an attachment mechanism to move the attachment mechanism from a recessed configuration to an extended configuration. In the illustrated embodiment, the engagement mechanism comprises first and second prongs 318*a,b*, which may collectively define a spanner wrench. The prongs 318*a,b* may extend from a backing plate 320. The prongs 318*a,b* may be configured to engage recesses in an attachment mechanism. For example, the prongs 318*a,b* may engage the recesses 224*a,b* in the head 204 of the above-described attachment mechanism 200.

Figure 6:
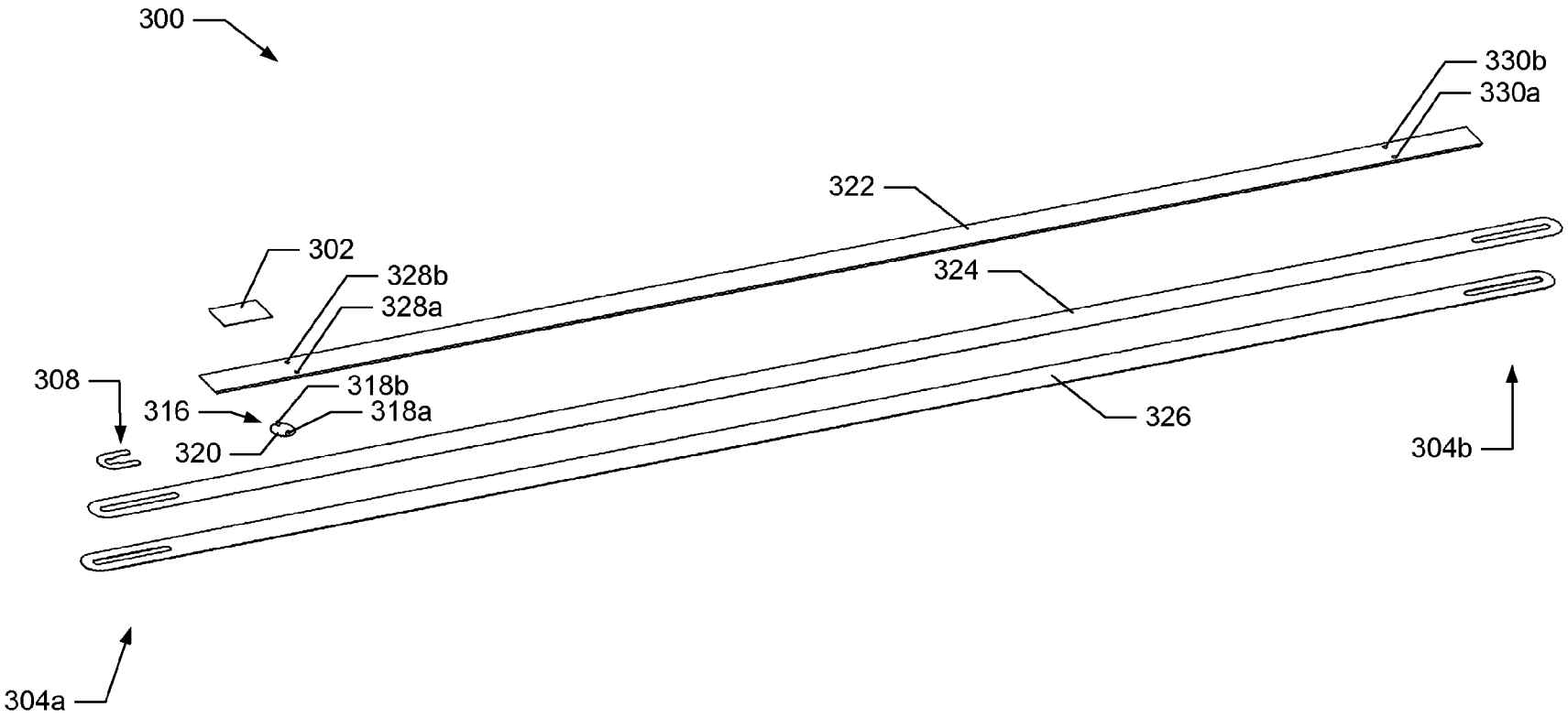
FIG. 6 illustrates an exploded view of the accessory device of FIG. 3.

FIG. 6 illustrates an exploded view of the lanyard 300. The lanyard 300 may comprise multiple layers. In the illustrated embodiment, the lanyard 300 comprises first, second, and third layers 322, 324, 326 of material. The first layer 322 may define an inner layer, the second layer 324 may define a middle layer, and the third layer 326 may define an outer layer when the lanyard 300 is formed into a loop. The material may comprise a fabric, nylon, plastic, rubber, or any other embodiment of material depending on the desired use of the lanyard 300.

As illustrated, the support member 308 may couple to an outer surface of the second layer 324 of the lanyard 300 in some embodiments. Further, in some embodiments the tool 316 may be embedded in the lanyard 300. More particularly, the backing plate 320 of the tool may be embedded in the lanyard 300 between the first layer 322 and the second layer 324 of the lanyard in one embodiment. Further, the engagement mechanism may extend through the first layer 322 such that it is accessible for use in moving an attachment mechanism between recessed and extended positions. For example, in the illustrated embodiment the prongs 318*a,b* extend through corresponding through holes 328*a,b* in the first layer 322 of the lanyard. Thereby, the prongs 318*a,b* may be accessible.

Accordingly, the prongs 318*a,b* may extend inwardly toward a center of the loop formed by the lanyard 300 when the adhesive member 302 secures the two ends 304*a,b* of the lanyard together. This may keep the prongs 318*a,b* generally out of view when not in use, which may be desirable. Further, in some embodiments the first layer 322 of the lanyard 300 may include a second set of through holes 330*a,b* at the opposite end 304*b* thereof. The second set of through holes 330*a,b* may be configured to receive the prongs 318*a,b* therein when the tool 316 is not in use. This configuration may prevent the prongs 318*a,b* from being visible when not in use and further this configuration may prevent the prongs from scraping or otherwise damaging the first layer 322. However, when the tool 316 is needed, the lanyard 300 may be twisted or otherwise manipulated such that the prongs 318*a,b* exit the second set of through holes 330*a,b* and are exposed for use.

Figure 7:
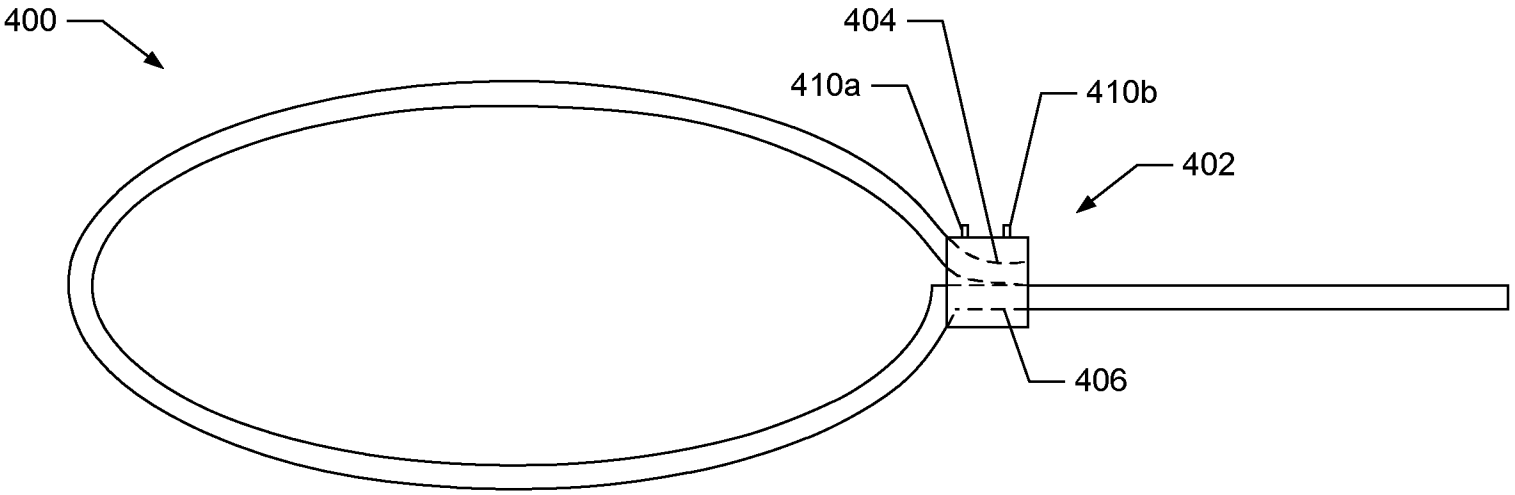
FIG. 7 illustrates a side view of an embodiment of an accessory device comprising a lanyard and a tool, wherein the tool acts as a clamp to hold the lanyard in a loop configuration according to an example embodiment of the present disclosure.
Figure 8:
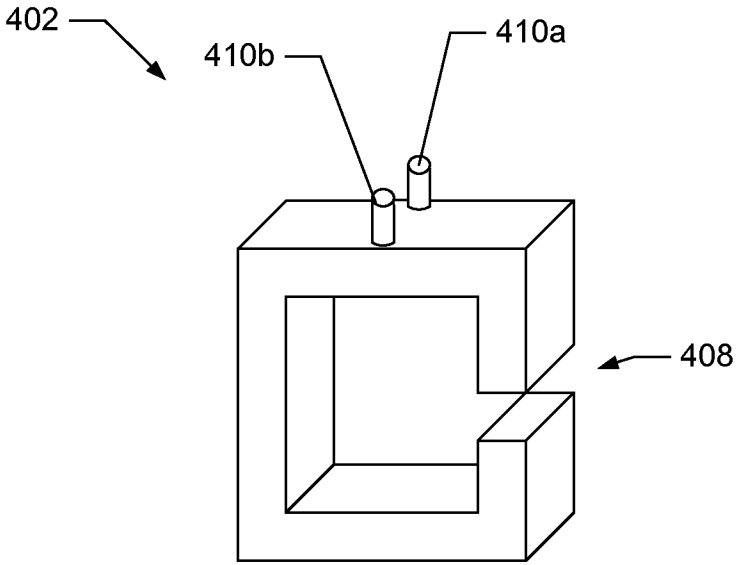
FIG. 8 illustrates an enlarged perspective view of the tool of FIG. 7.

FIG. 7 illustrates an alternate embodiment of a lanyard 400. As illustrated, a tool 402 may be coupled to the lanyard 400. The tool 402 may be configured to clamp together a first portion 404 of the lanyard 400 and a second portion 406 of the lanyard to form a loop. In this regard, as illustrated in FIG. 8, the tool 402 may define a gap 408 or other feature that allows the tool to be compressed to retain the first and second portions 404, 406 of the lanyard 400 in place. Thus, the tool 402 may plastically deformed during coupling to the lanyard 400, or the tool may define a spring bias configured to clamp the first and second portions 404, 406 of the lanyard in place. As illustrated in FIG. 8, the tool 402 may include prongs 410*a,b*, or another embodiment of an engagement mechanism in other embodiments, configured to engage an attachment mechanism, as described above.

Figure 9:
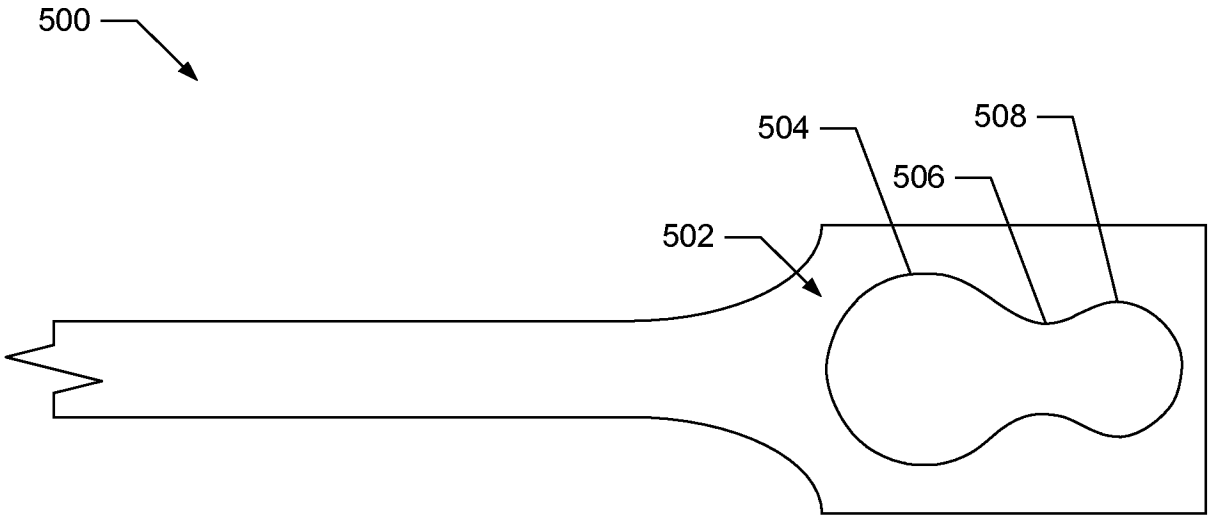
FIG. 9 illustrates an embodiment of a lanyard comprising an opening configured to engage a head of an attachment mechanism according to an example embodiment of the present disclosure.

FIG. 9 illustrates an additional embodiment of a lanyard 500. As illustrated, the lanyard 500 defines an opening 502 configured to engage an attachment mechanism. The opening 502 may be shaped such that it defines a major aperture 504 configured to receive the head of the attachment mechanism therethrough, a constriction 506, and a minor aperture 508 configured to engage a shaft of the attachment mechanism. However, since the lanyard 500 may be formed from a flexible material such as a fabric, the lanyard may not be sufficiently rigid to retain the attachment mechanism in the minor aperture 508. In this regard, the embodiment of the lanyard 300 illustrated in FIGS. 3-6 includes a support member 308.

Figure 10:
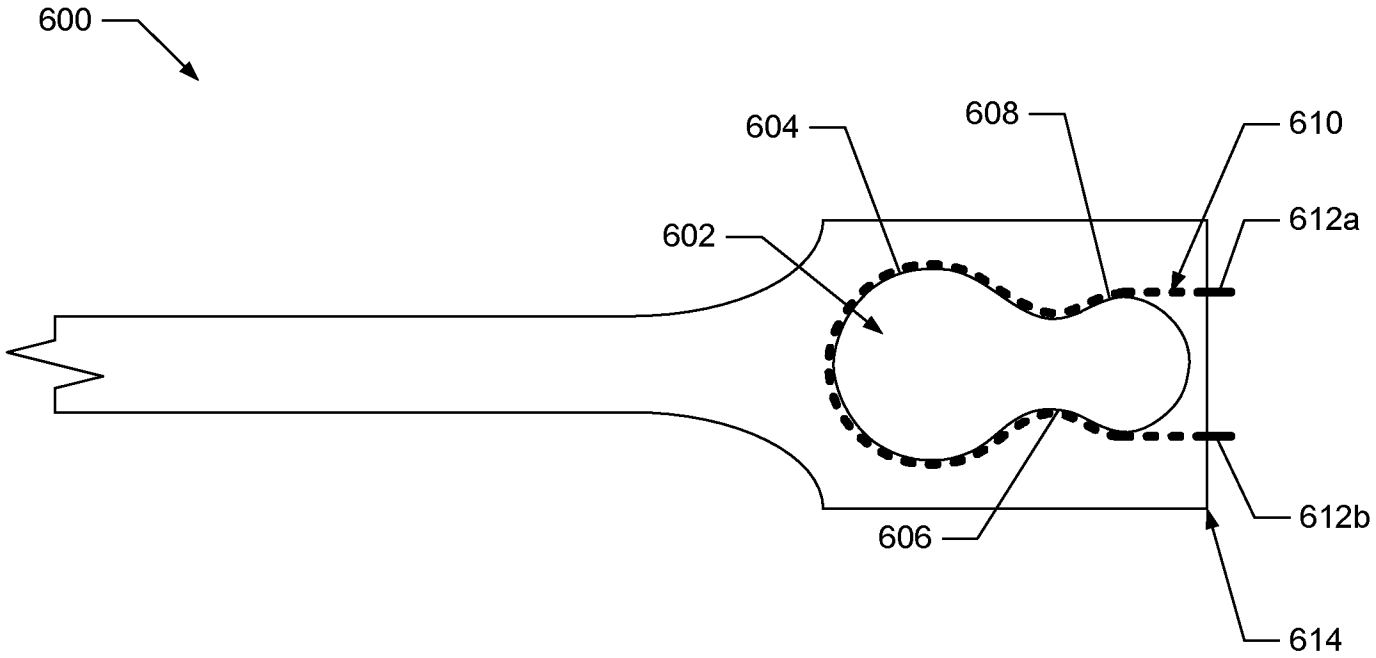
FIG. 10 illustrates an embodiment of an accessory device including a lanyard comprising an opening defining major and minor apertures and a tool comprising a wire configured to extend around at least a portion of the opening according to an example embodiment of the present disclosure.

However, Applicants have determined that a tool coupled to the lanyard may provide support and structure to an opening in a lanyard. In this regard, FIG. 10 illustrates an embodiment of a lanyard 600 that defines an opening 602. The opening 602 is shaped such that it defines a major aperture 604 configured to receive the head of the attachment mechanism therethrough, a constriction 606, and a minor aperture 608 configured to engage a shaft of the attachment mechanism, as described above. However, the lanyard 600 also includes a tool 610. The tool 610 comprises a wire that extends around at least a portion of the opening 602 in the lanyard 600. In this regard, the tool 610 defines a major aperture configured to receive the head of the attachment mechanism therethrough, a constriction, and a minor aperture configured to engage a shaft of the attachment mechanism. These features may substantially correspond to and/or be partially defined by, the major aperture 604, the constriction 606, and/or the minor aperture 608 of the opening 602.

Figure 11:
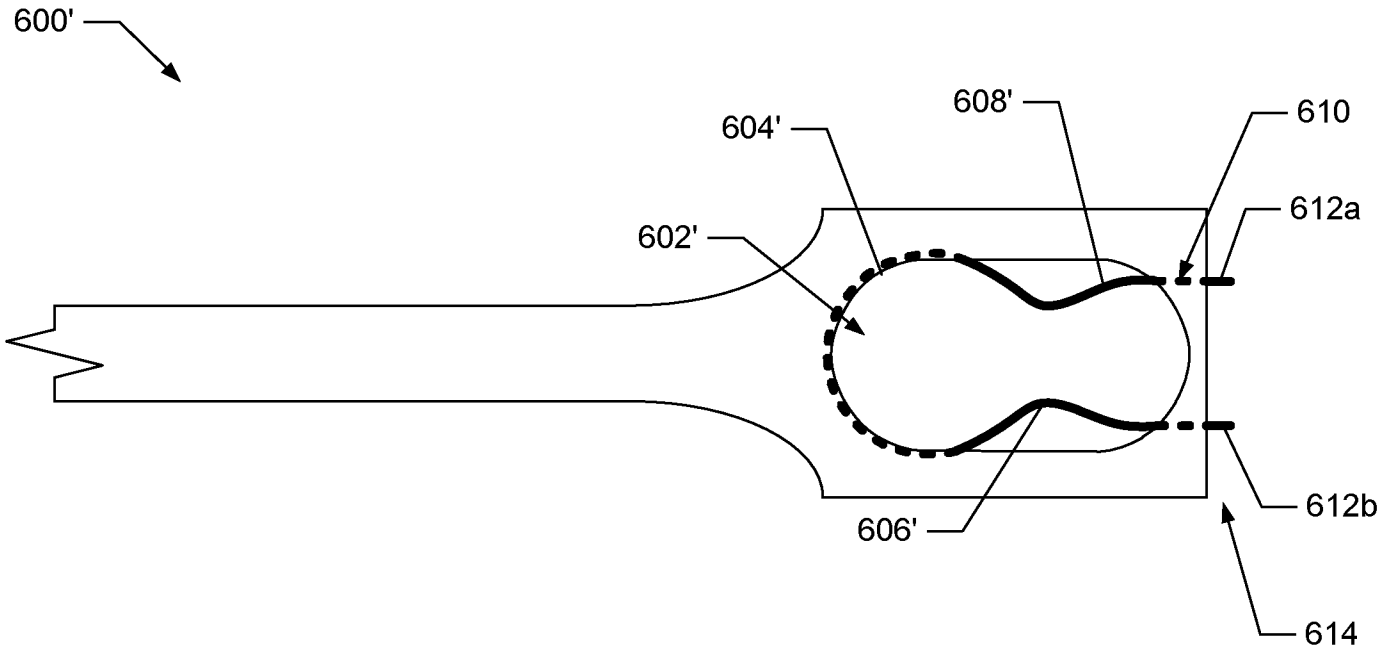
FIG. 11 illustrates an embodiment of an accessory device including a lanyard comprising an opening defining a generally ovular configuration and a tool comprising a wire configured to extend around at least a portion of the opening and define major and minor apertures according to an example embodiment of the present disclosure.

Note that although the opening 602 in the lanyard 600 is illustrated as defining the major aperture 604, the constriction 606, and the minor aperture 608, in another embodiment, this may not be the case. For example, in the embodiment of the lanyard 600' illustrated in FIG. 11, the opening 602' is generally ovular, and the constriction 606' is entirely formed by the tool 610, and the major aperture 604' and the minor aperture 608' are at least partially formed by the tool. Accordingly, the lanyard and the tool may respectively define some or all of the contours of the opening configured to engage an attachment mechanism.

Regardless of the particular implementation of the opening, the lanyard 600, 600' may include an engagement mechanism. In this regard, the tool 610 may include an engagement mechanism comprising a first end 612*a* and a second end 612*b* of the wire extending from an end 614 of the lanyard 600, 600'. The ends 612*a,b* of the tool 610 may be configured to engage a plurality of recesses in an attachment mechanism.

Figure 12:
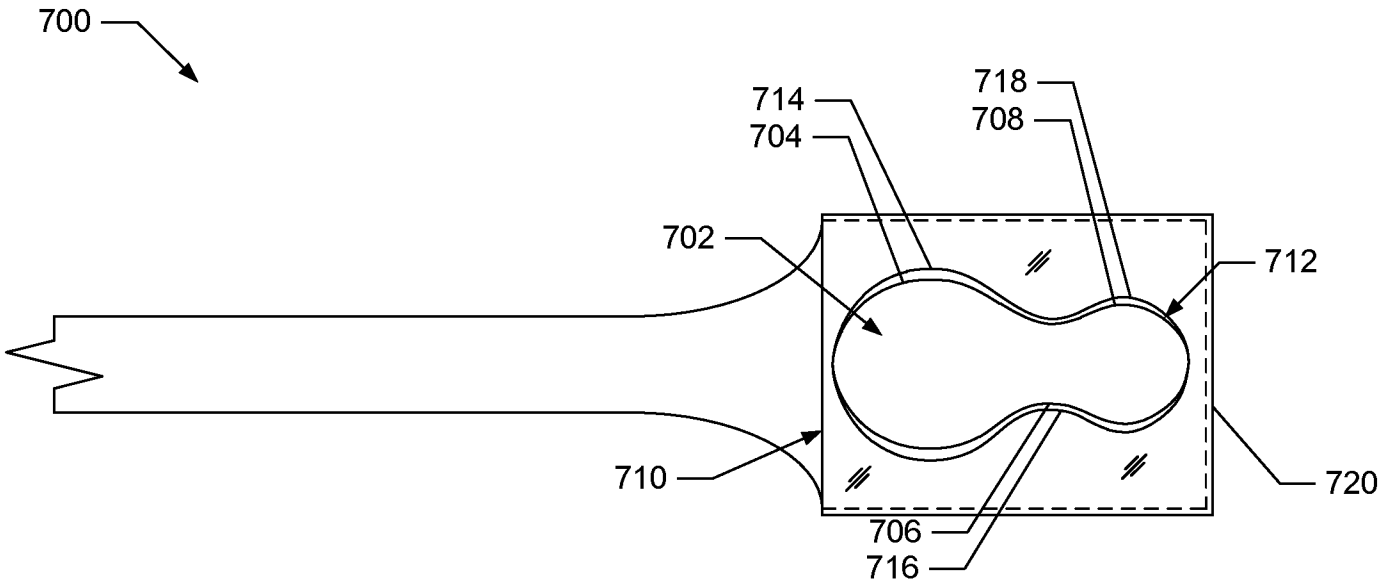
FIG. 12 illustrates an embodiment of an accessory device including a lanyard comprising an opening defining major and minor apertures and a tool comprising a substantially flat piece of material configured to extend around at least a portion of the opening according to an example embodiment of the present disclosure.

An alternate embodiment of a lanyard 700 defining an opening 702 is illustrated in FIG. 12. The opening 702 is shaped such that it defines a major aperture 704 configured to receive the head of the attachment mechanism therethrough, a constriction 706, and a minor aperture 708 configured to engage a shaft of the attachment mechanism, as described above. The lanyard 700 also includes a tool 710. The tool 710 may comprise a substantially flat piece of metal defining a hole 712 therethrough that is aligned with the opening 702 in the lanyard 700. In this regard, the tool 710 may extend around at least a portion of the opening 702 in the lanyard 700 and define a major aperture 714 configured to receive the head of the attachment mechanism therethrough, a constriction 716, and a minor aperture 718 configured to engage a shaft of the attachment mechanism. These features may substantially correspond to and/or be partially defined by, the major aperture 704, the constriction 706, and/or the minor aperture 708 of the opening 702 in the lanyard 700.

Figure 13:
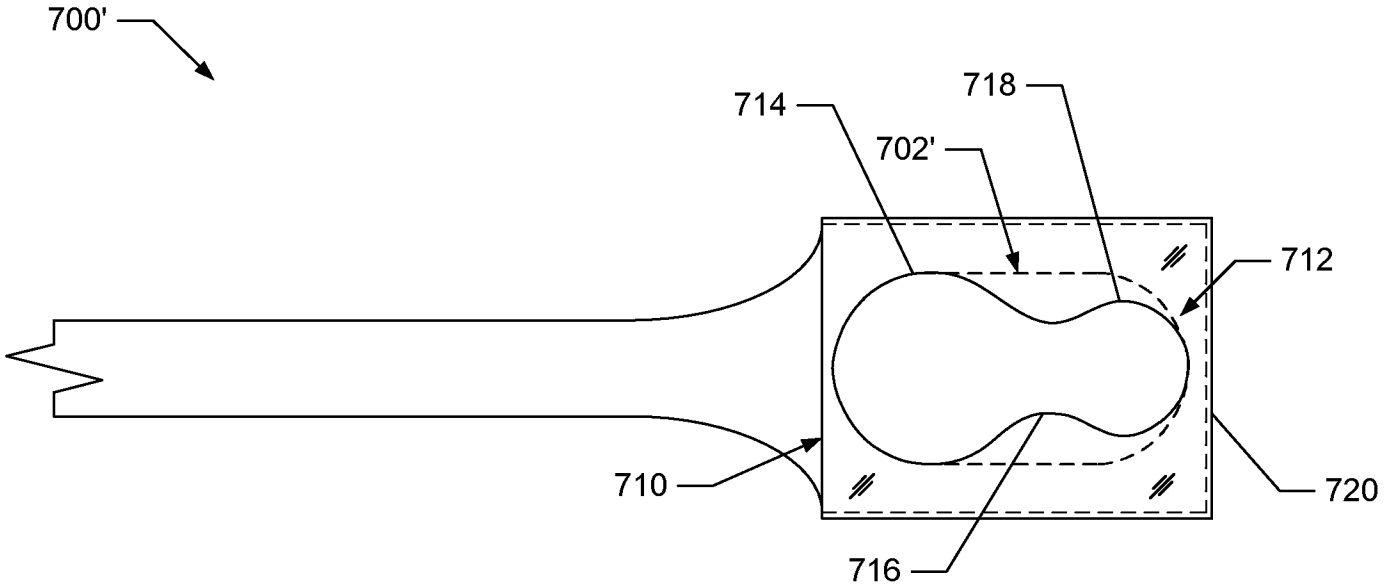
FIG. 13 illustrates an embodiment of an accessory device including a lanyard comprising an opening defining a generally ovular configuration and a tool comprising a substantially flat piece of material configured to extend around at least a portion of the opening and define major and minor apertures according to an example embodiment of the present disclosure.

Note that although the opening 702 in the lanyard 700 is illustrated in FIG. 12 as defining the major aperture 704, the constriction 706, and/or the minor aperture 708, in another embodiment, this may not be the case. For example, in the embodiment of the lanyard 700' illustrated in FIG. 13, the opening 702' is generally ovular, and the constriction 716 is entirely formed by the tool 710, and the major aperture 714 and the minor aperture 718 are at least partially formed by the tool. Accordingly, the lanyard and the tool may respectively define some or all of the contours of the opening configured to engage an attachment mechanism.

Figure 14:
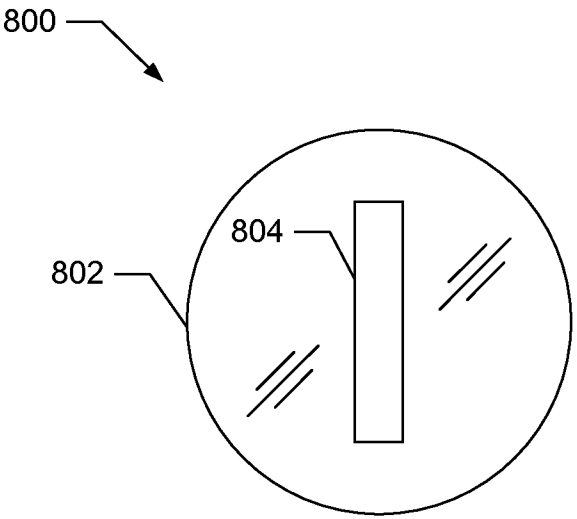
FIG. 14 illustrates an embodiment of a post for an attachment mechanism comprising a slot in a head thereof according to an example embodiment of the present disclosure.

Regardless of the implementation of the opening, the lanyard 700, 700' may include an engagement mechanism. In this regard, the tool 710 may include an engagement mechanism comprising an end 720 thereof. The end 720 of the tool 710 may be configured to engage an attachment mechanism. In this regard, whereas the attachment mechanisms have generally been describe above as defining a plurality of recesses, for example two round recesses, embodiments of the tools disclosed herein may be configured to engage other embodiments of attachment mechanisms. For example, FIG. 14 illustrates an overhead view of a post 800 for an attachment mechanism comprising a head 802 including a slot 804 therein. In this regard, the end 720 of the tool 710 included with the lanyards 700, 700' illustrated in FIGS. 12 and 13 may be configured to fit inside and engage the slot 804. Thus, the engagement mechanism may comprise a flat head screwdriver in some embodiments.

Note that although the present description generally discusses use of the tools provided herein as being useable to engage recesses in a head of an attachment mechanism to move the attachment mechanisms between recessed and extended configurations, in other embodiments the tool may engage the attachment mechanism via alternate methods and structures. For example, the tool may additionally or alternatively include a Phillips head screwdriver, a high friction surface, or any other shape or material configured to mate with another mechanism. In one alternative embodiment the tool may comprise a pin which, when inserted into the electronic device, releases an attachment mechanism.

Further, although the tools disclosed herein are generally described as being used to move an attachment mechanism from a recessed configuration to an extended configuration, the tools may additionally or alternatively be employed to move an attachment mechanism from the extended configuration to the recessed configuration. Additionally, the tools disclosed herein may be configured to perform other functions in addition to, or alternate from moving an attachment mechanism between recessed and extended configurations.

Figure 15:
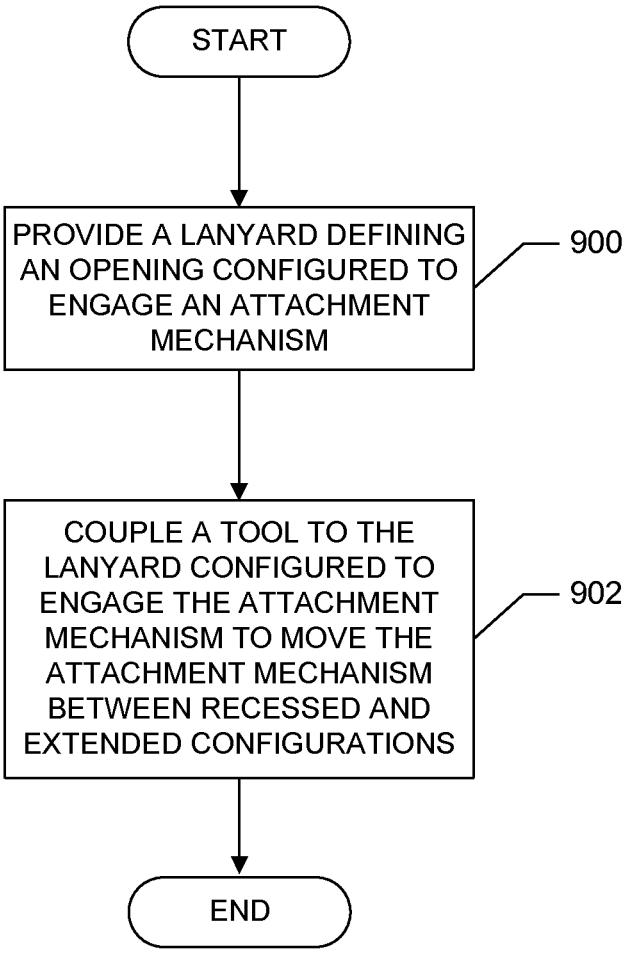
FIG. 15 illustrates a schematic diagram of a method for assembling an accessory device comprising a lanyard and a tool according to an example embodiment of the present disclosure.

Embodiments of related methods for assembling an accessory device are also provided. As illustrated in FIG. 15, the method may include providing a lanyard defining an opening at operation 900. The opening may be configured to engage a head of an attachment mechanism coupled to an electronic device to couple the lanyard to the electronic device. Additionally, the method may include coupling a tool to the lanyard at operation 902. The tool may comprise an engagement mechanism configured to engage the attachment mechanism to move the attachment mechanism from a recessed configuration to an extended configuration.

In some embodiments of the method, coupling the tool to the lanyard at operation 902 may comprise embedding a backing plate of the tool in the lanyard between a first layer and a second layer of the lanyard and extending the engagement mechanism through the first layer. In another embodiment coupling the tool to the lanyard at operation 902 may comprise clamping together an end of the lanyard to a remainder of the lanyard to form a loop. In an additional embodiment coupling the tool to the lanyard at operation 902 may comprise extending the tool around at least a portion of the opening in the lanyard. The method may further comprise joining the first and second portions of the lanyard together to form a loop, with the engagement mechanism extending inwardly toward a center of the loop.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. An apparatus, comprising:

a lanyard defining an opening configured to engage a head of an attachment mechanism coupled to an electronic device to couple the lanyard to the electronic device; and a tool coupled to the lanyard, the tool comprising an engagement mechanism configured to engage the attachment mechanism and be rotated by an end user of the tool to move the attachment mechanism from a recessed configuration to an extended configuration.

2. The apparatus of claim 1, wherein the tool further comprises a backing plate with the engagement mechanism extending therefrom.

3. The apparatus of claim 2, wherein the backing plate is embedded in the lanyard.

4. The apparatus of claim 3, wherein the backing plate is positioned between a first layer and a second layer of the lanyard, and the engagement mechanism extends through the first layer.

5. The apparatus of claim 1, wherein the tool clamps together a first portion of the lanyard and a second portion of the lanyard to form a loop.

6. The apparatus of claim 1, wherein the opening in the lanyard defines a major aperture configured to receive the head of the attachment mechanism therethrough and a minor aperture configured to engage a shaft of the attachment mechanism.

7. The apparatus of claim 6, wherein the tool comprises a wire that extends around a portion of the opening in the lanyard, and wherein the engagement mechanism comprises a first end and a second end of the wire extending from an end of the lanyard and configured to engage a plurality of recesses in the attachment mechanism.

8. The apparatus of claim 6, wherein the tool comprises a substantially flat piece of metal configured to engage a slot in the attachment mechanism, the substantially flat piece of metal defining a hole therethrough that is aligned with the opening in the lanyard.

9. The apparatus as recited in claim 1, wherein the lanyard further comprises a number of layers.

10. The apparatus as recited in claim 9, wherein the layers of the lanyard are formed of a material selected from the group consisting of fabric, nylon, plastic and rubber.

11. The apparatus as recited in claim 9, wherein the lanyard further comprises a support member disposed between two of the layers of the lanyard, the support member being positioned within a portion of the lanyard that defines the opening of the lanyard and configured to strengthen the portion of the lanyard defining the opening.

12. A system, comprising:

an electronic device comprising an attachment mechanism comprising a head configured to move between a recessed configuration and an extended configuration; and an accessory device comprising:

a lanyard defining an opening configured to engage the head of the attachment mechanism to couple the lanyard to the electronic device; and a tool coupled to the lanyard, the tool comprising an engagement mechanism configured to engage the attachment mechanism and be rotated by an end user of the tool to move the attachment mechanism from the recessed configuration to the extended configuration.

13. The system of claim 12, wherein the tool further comprises a backing plate with the engagement mechanism extending therefrom.

14. The system of claim 13, wherein the backing plate is embedded in the lanyard.

15. The system of claim 14, wherein the backing plate is positioned between a first layer and a second layer of the lanyard, and the engagement mechanism extends through the first layer.

16. The system of claim 13, wherein the opening in the lanyard defines a major aperture configured to receive the head of the attachment mechanism therethrough and a minor aperture configured to engage a shaft of the attachment mechanism.

17. The system of claim 16, wherein the tool comprises a wire, and wherein the engagement mechanism comprises a first end and a second end of the wire extending from an end of the lanyard and configured to engage a plurality of recesses in the attachment mechanism.

18. The system of claim 16, wherein the tool comprises a substantially flat piece of metal configured to engage a slot in the attachment mechanism, the substantially flat piece of metal defining a hole therethrough that is aligned with the opening in the lanyard.

19. The system of claim 12, wherein the tool clamps together a first portion of the lanyard and a second portion of the lanyard to form a loop.

* * * * *